US006772576B2

(12) United States Patent
Luehr et al.

(10) Patent No.: US 6,772,576 B2
(45) Date of Patent: Aug. 10, 2004

(54) METHOD FOR FILLING A TUBE AND CORRESPONDING DEVICE

(75) Inventors: Stefanie Luehr, Wedel (DE); Hartmut Manneck, Klein Wesenberg (DE); Martin Wemlinger, Wassertruedingen (DE)

(73) Assignee: Hans Schwarzkopf GmbH & Co. KG, Hamburg (DE)

( * ) Notice: Subject to any disclaimer, the term of this patent is extended or adjusted under 35 U.S.C. 154(b) by 0 days.

(21) Appl. No.: 10/284,925

(22) Filed: Oct. 31, 2002

(65) Prior Publication Data

US 2003/0061789 A1 Apr. 3, 2003

Related U.S. Application Data

(63) Continuation of application No. PCT/EP01/05192, filed on May 8, 2001.

(30) Foreign Application Priority Data

May 17, 2000 (DE) ..... 100 24 262

(51) Int. Cl.[7] ..... B65B 7/14

(52) U.S. Cl. ..... 53/469; 53/481; 53/284; 53/375.6

(58) Field of Search ..... 53/401, 402, 469, 53/480, 481, 482, 284, 266.1, 284.5, 375.6, 375.7

(56) References Cited

U.S. PATENT DOCUMENTS

| | | | | | |
|---|---|---|---|---|---|
| 1,975,996 | A | * | 10/1934 | Westin | 53/375.7 |
| 2,300,567 | A | * | 11/1942 | Hallead | 53/375.7 |
| 2,503,171 | A | * | 4/1950 | Posner | 53/469 |
| 2,691,474 | A | * | 10/1954 | Olson | 53/481 |
| 3,037,869 | A | * | 6/1962 | Esson et al. | 426/397 |
| 4,351,692 | A | * | 9/1982 | Ouellette | 53/482 |
| 5,014,492 | A | | 5/1991 | Fiorini et al. | |
| 5,144,788 | A | * | 9/1992 | Varlet | 53/469 |
| 5,714,023 | A | * | 2/1998 | Redfern | 53/469 |

FOREIGN PATENT DOCUMENTS

DE 87 08 939 1/1998

OTHER PUBLICATIONS

Derwent Acc. no. 1996–361339, clipped image and abstract for 1994SE–0003229 (Sep. 26, 1994).*

* cited by examiner

*Primary Examiner*—Stephen F. Gerrity
(74) *Attorney, Agent, or Firm*—Stephen D. Harper; Gregory M. Hill

(57) ABSTRACT

There is provided an improved method for filling a tube with a paste, ointment, gel or cream along with a device therefore which comprises simultaneously reducing the internal volume of the filled tube with the flattening and closure of the filling orifice.

8 Claims, 4 Drawing Sheets

METHOD FOR FILLING A TUBE AND CORRESPONDING DEVICE

CROSS REFERENCE TO RELATED APPLICATIONS

Figure 1:
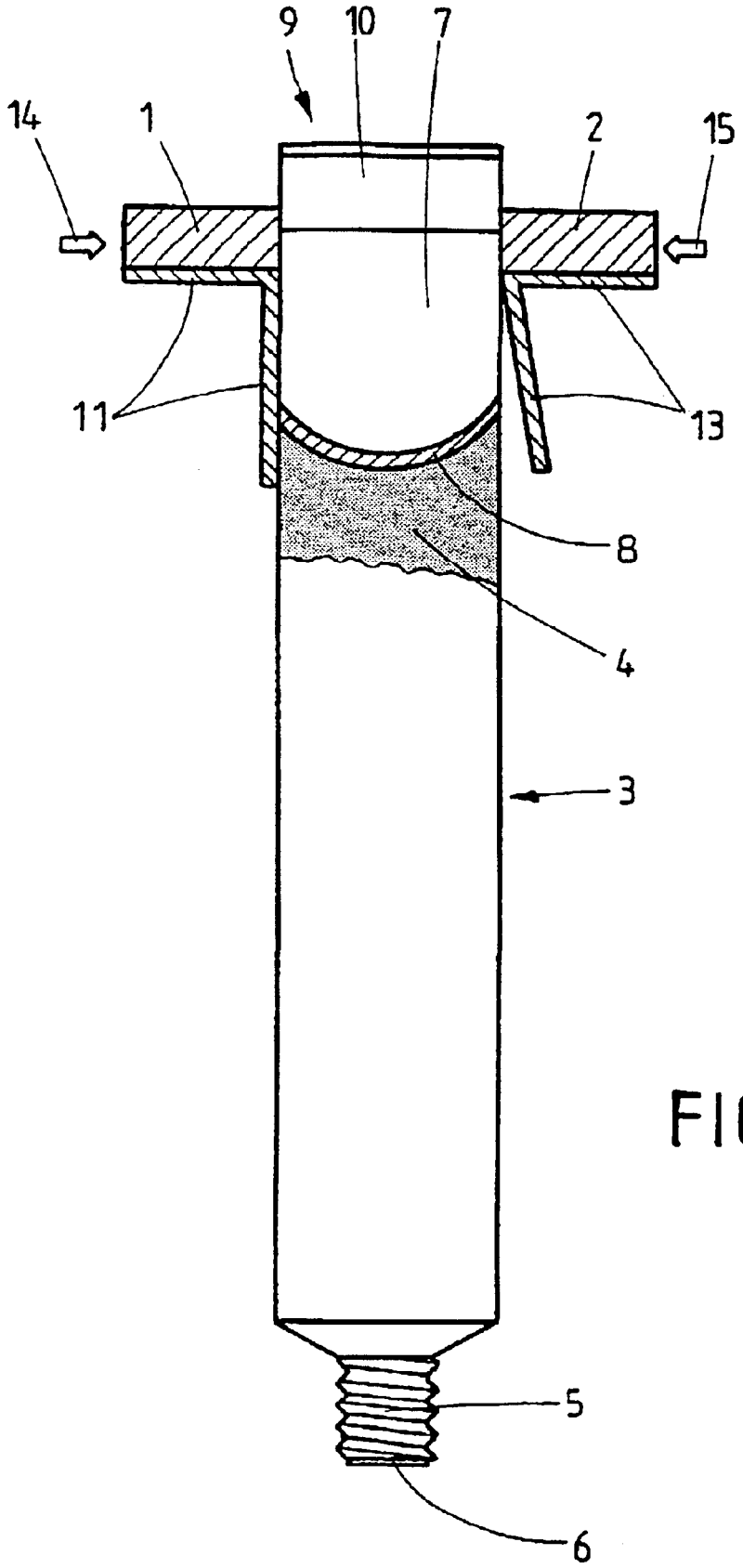

This application is a continuation under 35 U.S.C. §365 (c) and §120 of International Application No. PCT/EP01/05192 filed May 8, 2001 and under §119 of German Application No. 100 24 262.6 filed May 17, 2000.

SUMMARY OF THE INVENTION

The invention relates to a method for filling a tube with a paste, ointment, gel or cream, the tube consisting of a tubular or conical casing of flexible material, having a closable filling orifice at one end and being closed at the opposite end to the filling orifice, the filling orifice being flattened at least in its edge region once the paste, ointment, cream or gel has been introduced, the internal volume of the tube being reduced by means of a die that deforms the casing and the filling orifice being closed.

The invention relates, in particular, to the filling of aluminum or laminate tubes with products which are capable of oxidizing in air, for example oxidative coloring creams for coloring hair in hair cosmetology. It is known to fill a coloring cream tube of this type in a plurality of steps. Nitrogen gas is initially introduced into the empty tube. The coloring cream is then introduced from bottom to top, in other words beginning with the still closed end of the tube. After introducing further nitrogen gas, the filling orifice is flattened and folded by closing two folding jaws. The folding process takes place in a known manner. To prevent the subsequent penetration of air, an annular latex film or a heat sealing lacquer is applied internally to the tube end. When the tube is closed, the filling orifice is initially flattened so the latex-coated internal regions of the filling orifice rest against one another and form a gas-tight seal after compression. When heat sealing lacquer is used, the lacquer is melted by heating jaws and the hermetic seal achieved in this way.

In practice, it is impossible to prevent a relatively large space filled predominantly with nitrogen gas from remaining between the content of the tube, i.e. the coloring cream in the specific case, and the closure of the filling orifice. However, this space still contains sufficient atmospheric oxygen to oxidize and therefore discolor the exposed surface of the coloring cream facing the filling orifice, over the course of time. The user will then observe undesirable discoloration and streaks when the coloring cream is squeezed out.

BACKGROUND OF THE INVENTION

The method of the type mentioned at the outset is known from German Utility Model DE 87 08 939 U1. In that case, the amount of residual air remaining in a bag for a medical infusion liquid after closure of the container is to be substantially reduced. Once the container consisting of plastics material has been filled, the size of the filling orifice is reduced by a first welding process. The filling level is then raised into the filling nozzle by elastic deformation of the container. In the process, a die integrated in the blow mould for the plastic bottle is pressed against the main part of the container casing which is arranged remotely from the filling orifice and below the filling level of the infusion liquid. Finally, the mouth of the filling nozzle remaining after the first welding process is welded in a second welding process.

A drawback of this known method is the requisite expenditure which is manifested, on the one hand, by the number of steps of the method. Three steps are required, namely a first welding process, elastic deformation of the container and finally a second welding process. Complex modification of the filling device is also required. A separate die with an actuating element and a corresponding drive has to be installed in the holder or in the blow mould. Finally, a control means for the die drive has to be fitted to maintain predetermined deformation of the container. In fact, if the container is excessively deformed, the content of the container is squeezed out of the filling orifice and this results in corresponding soiling of the tube filling facility and difficulty in welding the filling nozzle which has been wetted by the product in its interior.

It is accordingly the object of the invention to develop the method of the type mentioned at the outset so as to considerably reduce the volume of the gas-filled space remaining in the closed tube, in a cost-effective, simple and unproblematic manner, necessitating minimal modification of the filling facility and no change to the filling method or the tube.

DETAILED DESCRIPTION OF THE INVENTION

This object is achieved according to the invention by the method mentioned at the outset in that the internal volume of the tube is reduced simultaneously with the flattening and closure of the filling orifice. According to the invention the internal volume of the tube is reduced not between two welding processes as in the method according to DE 87 08 939 U1, but simultaneously with the flattening and closure of the filling orifice. Instead of three steps during closure of the container according to the prior art, only a single step is required according to the invention.

In particular, it is proposed to reduce the internal volume of the tube by pressing a triangular region of the casing, adjoining the filling orifice against the opposite side of the casing, the vertex of the triangle pointing toward the closed end of the tube. The container is deformed substantially in the region above the product, in other words in the region of the gas content. The deformation provided according to the invention may be retained after final closure of the tube as it corresponds exactly to the transition from the cylindrical part of the filled tube to the flat region and therefore does not impair the aesthetic appearance and is relatively unnoticeable.

To make the tube particularly impermeable to air and, in particular, to atmospheric oxygen, it is also proposed that the tube consists of metal, in particular of aluminum, in a manner known per se.

It is also advantageous to use tubes having an annular film of latex or the like on the interior of the filling orifice. After being folded and welded, tubes of this type are particularly airtight in the region of the fold.

The invention also relates to a device for carrying out the method according to the invention, comprising two opposing clinching jaws which can be moved toward or away from one another. These clinching jaws have the function of flattening and folding the filling orifice of the tube.

The above-mentioned object of the invention is achieved here in that a die is mounted on one clinching jaw and a plate-shaped counterpart on the other clinching jaw. If the clinching jaws move toward one another during closure of the tube, the casing limiting the gas-filled space of the tube is thus squeezed at the same time to a predetermined extent, the residual gas content being considerably reduced. A separate step and an expensive control means for the deformation of the container is not required according to the invention.

It is also proposed that the die has the form of a triangular plate, the vertex of the triangle pointing away from one clinching jaw. The advantages of the resultant triangular deformation have been mentioned hereinbefore.

Existing facilities may be converted in a particularly simple, unproblematic and cost-effective manner if the die and the counterpart are fixed directly and rigidly to the respective clinching jaw according to a further embodiment of the invention. It is particularly clear here that, according to the invention, the flattening of the filling orifice reduces the volume of the region of the tube containing the residual gas.

It is also proposed that the pressing face of the die is arranged substantially parallel to the longitudinal axis of the device and the pressing face of the counterpart is arranged obliquely outwardly from this longitudinal axis. The longitudinal axis of the device is determined by the longitudinal axis of the tube. In this embodiment, the counterpart prevents damage to the front of the tube which rests thereon and generally carries an inscription.

Finally, it is proposed that the arms of the counterpart and of the die are arranged at right angles to one another. However, the arms may be arranged at an acute angle of up to 45° to one another. The angles of the counterpart and the die are not generally identical, the die being at a right angle and the counterpart at a smaller angle.

Figure 2:
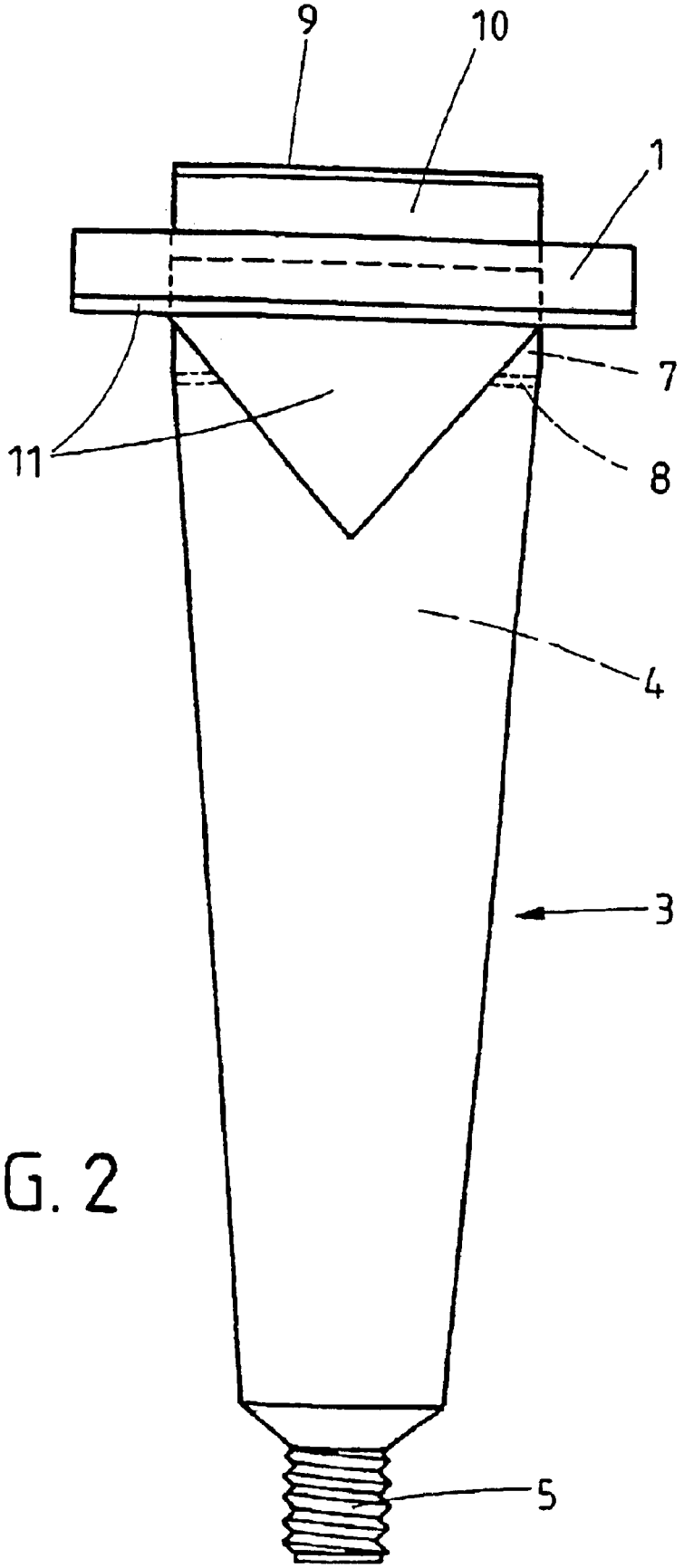
Figure 3:
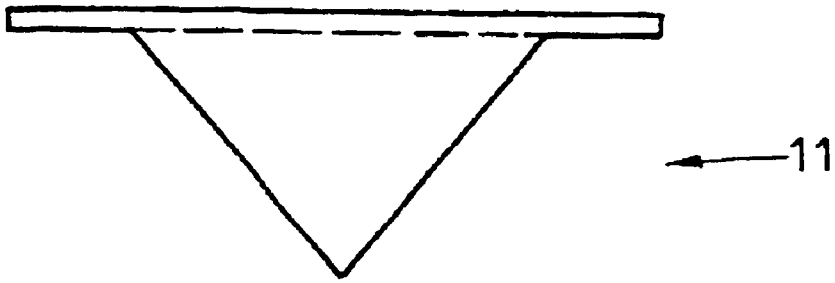
Figure 4:
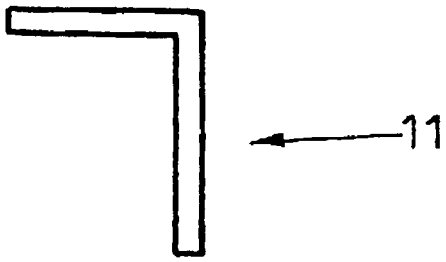
Figure 5:
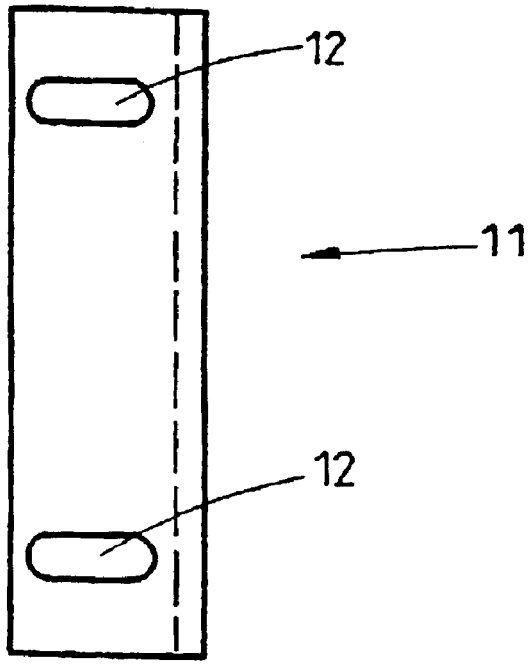
Figure 6:
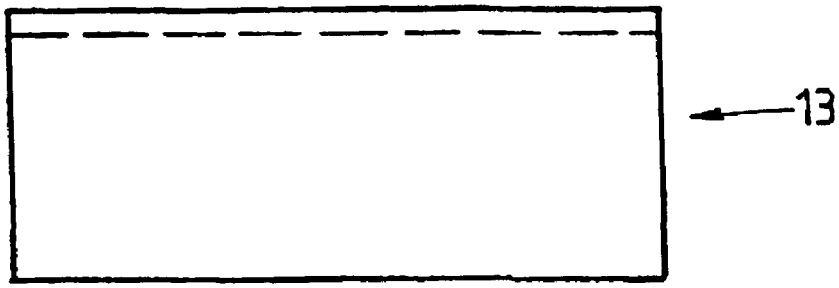
Figure 7:
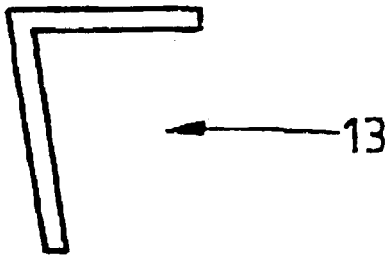
Figure 8:
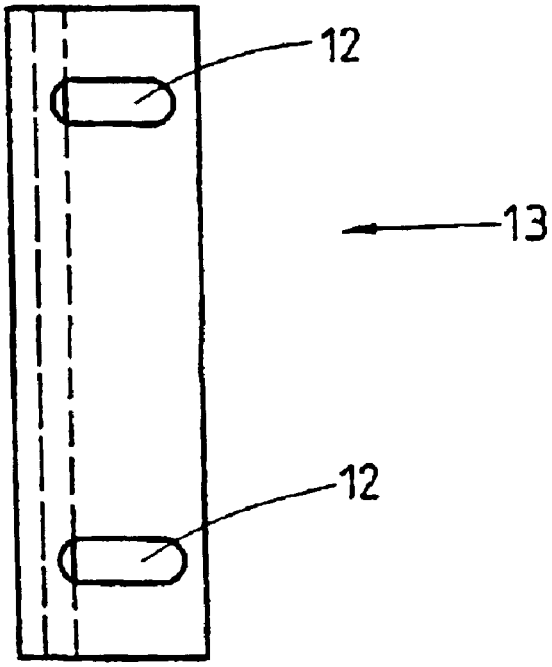

An embodiment of the invention will be described in more detail hereinafter with reference to drawings, in which:

FIG. 1 is a side view of a tube fixed between two clinching jaws before closure of the filling orifice according to the invention, FIG. 2 is a view of the back of the tube in the arrangement of FIG. 1, after flattening the filling orifice, FIG. 3 is a front view of the die according to the invention, FIG. 4 is a side view of the die according to FIG. 3, FIG. 5 is a plan view of the die according to FIGS. 3 and 4, FIG. 6 is a front view of the plate-shaped counterpart according to the invention, FIG. 7 is a side view of the counterpart according to FIG. 6 and FIG. 8 is a plan view of the counterpart according to FIGS. 6 and 7.

In all drawings, like reference numerals have like meanings and may therefore be described only once.

The invention is particularly suitable for filling tubes with oxidative coloring creams used in hair cosmetics. As there are often many different color ranges and many different shades per color range, and different color ranges often signify different cream bases and correspondingly different volumes, this leads to different degrees of filling of the tubes if an appropriate uniform tube size is used for all color ranges and shades. In one case, therefore, the volume introduced into the tube is sufficiently large just to prevent the product from entering the fold when the filling orifice is closed. At the other extreme, however, the filling level is so low that a comparatively large gas-filled space remains above the product. It is not technically possible to completely exclude atmospheric oxygen, so oxidation may occur at the boundary layer of in these oxidative coloring creams. This results in a pronounced deterioration in the quality of the product, and the customer may object optically to the differently colored layer when the cream is squeezed from the tube.

FIG. 1 is a side view of a tube 3 fixed between two clinching jaws (folding jaws) 1, 2. The terms "front" and "side view" relate to the finished tube which is flattened at its back end, the front of the tube carrying the main inscription. In the step of the method shown in FIG. 1 the oxidative coloring cream 4 is introduced into the tube 3 which consists of aluminum and is completely closed in its lower region. An external thread is applied to the outlet nozzle 5 in the conventional manner, and the orifice 6 of the outlet nozzle 5 is tightly and hermetically sealed by an aluminum membrane, also in the conventional manner. The membrane is perforated by the user when the tube is opened for the first time.

Although nitrogen gas has been introduced into the gas-filled space 7 above the coloring cream 4, an oxidized layer 8 has formed at the interface between the coloring cream 4 and the gas-filled space 7 owing to residual oxygen. The known latex film 10 at the interior of the tube 3 and almost directly adjoining the filling orifice 9 can also be seen.

An angular part known as the die 11, of which the shape is shown clearly in FIGS. 2 to 5, is fastened to the underside of one clinching jaw 1. It is screwed on one clinching jaw 1 by means of the longitudinal slot 12 (FIG. 5).

A corresponding angled plate-shaped counterpart 13 is accordingly applied to the underside of the other clinching jaw 2. Its shape can be seen most clearly in FIGS. 6 to 8.

If the clinching jaws 1, 2 move toward one another in the direction of the arrows 14, 15, the filling orifice 9 of the tube 3 is flattened. At the same time, the gas-filled space 7 above the coloring cream 4 is squeezed together much more vigorously with the die 11 and the counterpart 13 than without the die 11 and the counterpart 13, the oxidized layer 8 moving upwardly in the direction of the filling orifice 9, as shown schematically in FIG. 2. In this process, the counterpart 13 below the other clinching jaw 2 prevents the front of the tube from being damaged. On the other hand, the die 11 is pressed into the back of the tube. As a result, the gas-filled space 7 between the coloring cream 4 and the latex ring 10 is considerably reduced. The majority of the surface of the coloring cream 4 is now covered with the internal protective lacquer applied to the interior of the aluminum tube, and a slight oxidized layer could be formed merely at the two outer ends of the tube. A further advantage is that external soiling of the tube by escaping filling can be substantially prevented owing to the constructional arrangement.

If desired, the shape, size and curvature of the die 11 and of the counterpart 13 may be varied and optimized as necessary.

To sum up, the advantages of the invention reside, in particular, in the reduction of the discolored oxidized layer. As the coloring cream is pressed into the top corners of the tube 3, namely into the region of the fold, by the die 11, the undesirable oxidized layer can no longer be squeezed from the tube.

The shape of the die 11 is selected in such a way that the necessary space is reserved between the coloring cream 4 and the fold, but is sufficiently small. The geometric configuration of the die 11 substantially prevents undesirable contact between the product and the latex film 10 of the tube 3. This is achieved in that the coloring cream 4 in the tube is guided only into the two outermost corners by the die 11. Therefore, a substantially smaller amount of product enters the latex film 10 at the end of the tube than with maximum filling of a tube without application of the invention. Owing to the action of the clinching jaws 1, 2, furthermore, about 5 to 10 mm below the latex film 10 and the arrangement of the die 11 about 2 mm deeper, sufficient space is reserved for this small amount of product. If there are extreme variations in the filling levels, which might be caused, for example, by gas bubbles in the coloring cream itself, it is also possible to apply the die 11 to the clinching jaw 1 in such a way that it presses more or less strongly on the tube casing.

The tubes cannot be impaired or damaged from the exterior. Owing to the different construction of the die 11 which has the form of a triangle and of the counterpart with a smooth rectangular face, with the two parts 11, 13 pressing on the tube surface with the clinching jaws 1, 2 in a single operation, no visible change is produced on the side of the tube on which the smooth face of the counterpart 13 presses. The conventional curvature, of which the shape is now predetermined, is obtained on the back of the tube on which the die 11 presses. Damage to the lacquer on the tube surface is prevented because, on the one hand, the stress is only a fraction of the stress at the ends of the fold and, on the other hand, the surface of the die 11 and of the counterpart 13 does not have sharp edges. Any edges which appear are rounded.

LIST OF REFERENCE NUMERALS

1 One clinching jaw
2 The other clinching jaw
3 Tube
4 Coloring cream
5 Outlet nozzle
6 Orifice
7 Gas-filled space
8 Oxidized layer
9 Filling orifice
10 Latex film
11 Die
12 Longitudinal slot
13 Counterpart
14 Arrow
15 Arrow

What is claimed is:

1. A method for filling a tube with a paste, ointment, gel or cream, said tube consisting of a tubular or conical casing of flexible material having a closable filling orifice at one end and being closed at the opposite end to said filling orifice and, subsequent to said filling, the filling orifice being flattened at least in its edge region and the internal volume of the tube being reduced by means of a die that deforms the casing and closes said filling orifice, said method comprising the simultaneous reduction of the internal volume with the flattening and closure of the filling orifice wherein said reduction of the internal volume of the tube is achieved by pressing a triangular region of the casing adjoining the filling orifice against the opposite side of the casing and wherein the vertex of the triangle that is not affixed to the die is pointed toward the closed end of the tube.

2. The method of claim 1 wherein the tube is metal.

3. The method of claim 2 wherein the metal is aluminum.

4. The method of claim 1 wherein the tube has an annular film of latex on the interior of the filling orifice.

5. A device for filling a tube with a paste, ointment, gel or cream comprising two opposing clinching jaws adapted to move toward and away from one another, having a die mounted on one clinching jaw and a plate-shaped counterpart on the other clinching jaw wherein the pressing face of the die is positioned substantially parallel to the longitudinal axis of said device and the pressing face of the plate-shaped counterpart is positioned obliquely outwardly from the longitudinal axis of said device.

6. The device of claim 5 wherein the die has the form of a triangular plate, the vertex of the triangle that is not affixed to the die pointing away from one clinching jaw.

7. The device of claim 5 wherein the die and the counterpart are fixed directly and rigidly to the respective clinching jaw.

8. The device of claim 5 wherein the counterpart or the die has arms enclosing an angle of 45° to 90°.

* * * * *